United States Patent [19]

Klöcker et al.

[11] Patent Number: 5,040,571

[45] Date of Patent: Aug. 20, 1991

[54] LIFTING HEDDLE WITH ADJUSTABLE SECTIONS

[75] Inventors: Heinrich J. Klöcker, Borken; Werner Wanning, Südlohn, both of Fed. Rep. of Germany

[73] Assignee: Klocker-Entwicklungs-GmbH, Borken/Westf., Fed. Rep. of Germany

[21] Appl. No.: 510,606

[22] Filed: Apr. 17, 1990

[30] Foreign Application Priority Data

Apr. 19, 1989 [DE] Fed. Rep. of Germany ..... 3912733

[51] Int. Cl.[5] ..... D03C 7/00

[52] U.S. Cl. ..... 139/52

[58] Field of Search ..... 403/43–48; 139/50–54

[56] References Cited

U.S. PATENT DOCUMENTS 2,665,489 1/1954 Cunningham ..... 403/44 X
3,990,481 11/1976 Horgenberg et al. .
4,967,802 11/1990 Klocker et al. .

FOREIGN PATENT DOCUMENTS 352480 4/1961 Switzerland ..... 403/43
535304 6/1972 Switzerland ..... 139/50

*Primary Examiner*—Andrew M. Falik
*Attorney, Agent, or Firm*—Collard, Roe & Galgano

[57] ABSTRACT

A lifting heddle with a body which includes at least two separate sections joined by a link. The separate sections are adjustably joined so that the lifting heddle can be lengthened and shortened. The link can be provided as a U-shaped rail with openings or recesses to allow escape of any accumulated dust. Also, a replaceable stop is located on the lifting heddle to prevent the half-heddle leg from cutting into the lifting heddle during movement of the heddle frames.

24 Claims, 3 Drawing Sheets

LIFTING HEDDLE WITH ADJUSTABLE SECTIONS

BACKGROUND OF THE INVENTION

The present invention relates generally to a hoist, and more particularly to lifting heddles for hoists.

Known lifting heddles are formed as one-piece elements and are provided at each end with a structure for accommodating the heddle frame. It is, however, necessary to vary the length of the heddles, for example to increase or decrease the shed. With the known lifting heddles this can only be done by replacing the heddle with a heddle of a different length.

SUMMARY OF THE INVENTION

Accordingly, it is an object of the present invention to provide a lifting heddle that can be lengthened and shortened.

This object is attained according to the present invention by the provision of a lifting heddle which has a body composed of at least two parts.

In accordance with one embodiment of the invention, the body of the lifting heddle can be separated in the middle to define an upper section and lower section which can be connected with one another by a link.

The link can be formed as a U-shaped rail having two sidewalls connected with one another by a base wall. In accordance with another embodiment of the invention, the end of the base wall and/or the sidewalls of the U-shaped rail can be tapered. The advantage of this construction is that the doup end that travels along the U-shaped rail does not encounter substantial resistance that it would otherwise encounter if the end of the base wall and/or the sidewalls were parallel.

One section of the body of the lifting heddle can be wider than the other section in a known way. The two sections can be riveted, screwed, or cemented together.

In accordance with the present invention, heddles of varying length can be produced by shortening of their sections and thereafter connecting them by means of the link.

The sections of the body of the heddle can be made of plastic and the link can be made of metal. A metal link is less subject to wear that can occur when the doup end travels along it, especially when the threads are composed of glass or metal.

The link can be provided with openings to allow escape of any accumulated dust. One of such openings can be a recess provided in the base wall of the U-shaped rail. The openings can also be formed in the sidewalls of the U-shaped rail.

In accordance with a further embodiment of the invention, the link in the vicinity of the end of a positioning slot in the wider section of the body of the heddle is as wide as the narrower section, exposing the end of the slot. This design facilitates the removal of any dust that may have accumulated.

In another embodiment of the invention, fasteners that accommodate the heddle frames are positioned at each end of the body of the heddle. Heddles of varying length are produced in accordance with this embodiment by appropriately shortening the section of the body of the heddle at the top or bottom before the fasteners are positioned on the sections. The fasteners can have a slot that accommodates the upper or lower section of the lifting heddle. The section can be secured in a fastener made of plastic by cementing or welding.

In accordance with another embodiment of the invention, the sections of the body of the lifting heddle have different widths, a fastener for accommodating a heddle frame is provided at each end, and means for controlling the heddles are positioned on the wider section. A similar lifting heddle is known from German document GM 8 807 217.7.

However, this embodiment has a drawback in that the metal leg of the half heddle collides with the inner wall of the lifting heddle during the alternating motion of the heddle frames and eventually cuts into it. Once the heddle has been cut into, binding errors can occur, because it can no longer be ensured that the doup end will travel from one end of the half heddle to the other while the sheds are changing.

In accordance with the invention, this drawback is eliminated by the provision of a stop for the half heddle on the wider section of the body of the inventive lifting heddle. Before the half-heddle leg can come into contact with the inner wall of the lifting heddle, the end of the half heddle will come into contact with the stop. The distance between the stop and the inner web of the lifting heddle is approximately equal to the length of the half-heddle section. Preferably, the stop is made of plastic and is removable and replaceable.

In this embodiment, the wider section of the lifting heddle can have a slot for positioning the half heddle, with the stop positioned in the slot.

Introducing a positioning slot in one section of the lifting heddle allows precise positioning of the half heddle. This is especially important when the wide section has magnets for magnetically controlling the metal half heddle. The positioning slot ensures that the magnets will always act on the half heddle, even when the heddle frames move rapidly.

To prevent accumulation of dust in the positioning slot, the end of the positioning slot in this section is preferably as wide as the upper section of the lifting heddle, exposing the end of the slot.

The novel features of the invention are set forth in particular in the appended claims. The invention itself however both as to its construction and manner of operation will be best understood from the following description of preferred embodiments which is accompanied by the following drawings.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DESCRIPTION OF THE PREFERRED EMBODIMENTS

Figure 1:
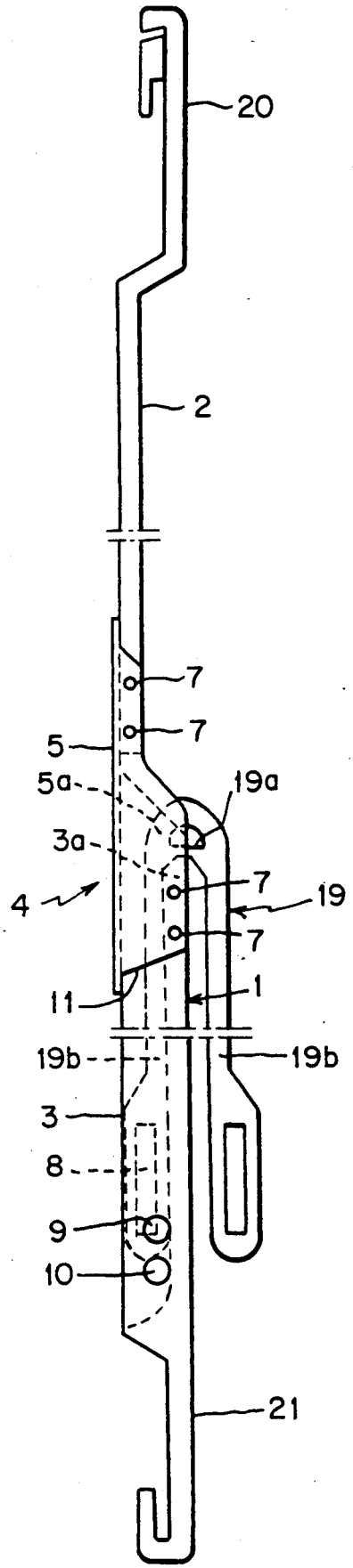
FIG. 1 is a front elevational view of a lifting heddle according to one embodiment of the present invention.
Figure 2:
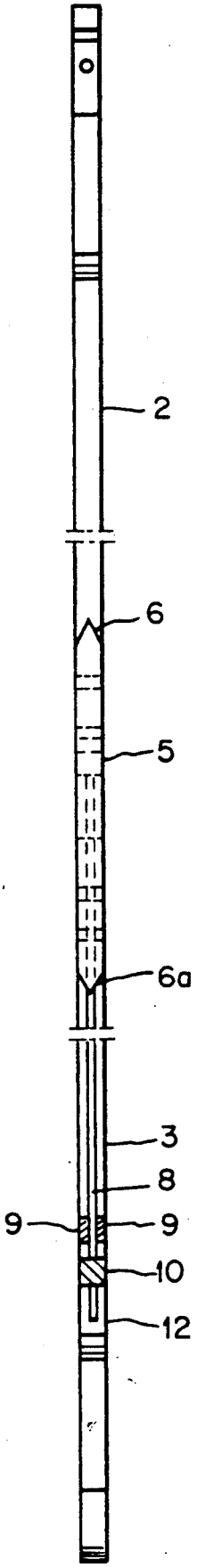
FIG. 2 is a side elevational view of the lifting heddle of FIG. 1.

Referring now in detail to the drawings and in particular FIGS. 1 and 2, therein illustrated is a lifting heddle 1 in accordance with the present invention. Lifting heddle 1 has a body which is composed of at least two separate sections, an upper section 2 and a lower section 3.

As can be seen from the drawings, the lower section 3 is wider than the upper section 2. A fastening element 20 is provided at a free end of upper section 2 and a fasteneing element 21 is provided at a bottom end of the lower section 3 for receiving weaving shafts or heddle frames (not shown). The upper section 2 is secured to the lower section 3 by a link 4. Link 4 is formed as a U-shaped rail with a base wall 5 and sidewalls 5*a*. The base wall 5 of the U-shaped rail is tapered to a point at each end 6 and 6*a*. The sidewalls 5*a* of the U-shaped rail are also tapered at edge 11, offering only slight resistance to the doup end as it travels along. The link is secured to sections 2 and 3 by rivets 7. Heddles of different lengths can be produced by appropriately shortening of the sections and then connecting them with one another by the above described link or U-shaped rail 4.

The wider lower section 3 has a slot 8 for positioning a half heddle 19. The positioning slot 8 is limited at the top by a wall 3*a*. Half heddle 19 has a wall 19*a* which rests on the wall 3*a* when it travels along with the lifting heddle. The positioning slot 8 has an outlet 12 at the bottom. The slot has a stop in the form of a pin 10, to prevent the half heddle 19 from cutting into the wall 3*a* over the long term during the motion of the heddle frames. The half heddle 19 has a leg 19*b* which comes into contact with the pin.

The pin is composed of a plastic material. It can be removed from lower section 3 and replaced when it becomes worn. Magnets 9 for controlling the half heddle are positioned in front of stop or pin 10.

Sections 2 and 3 are made of a plastic material. The link 4 or the U-shaped rail is made of metal, to make it more resistant to wear because it comes in contact with the doup ends.

Figure 3:
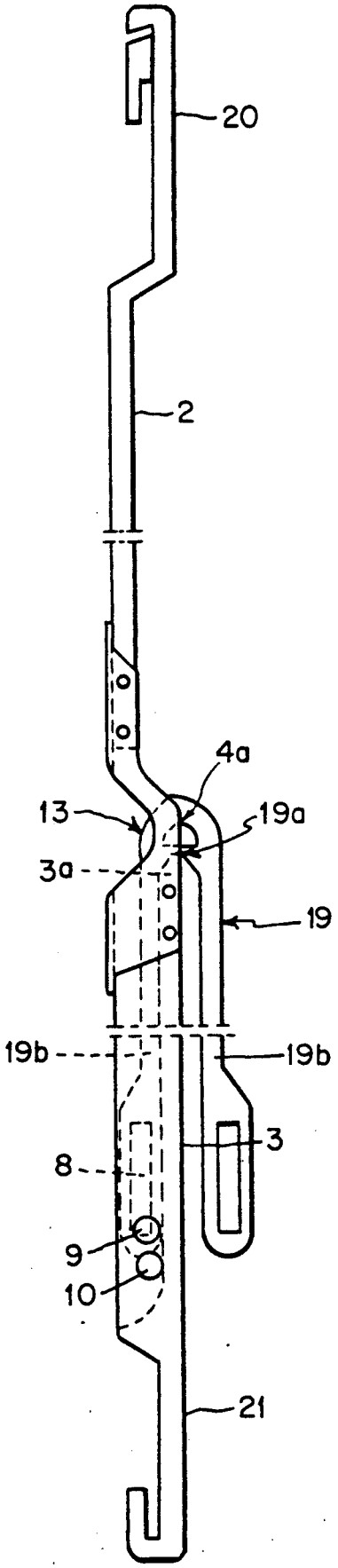
FIG. 3 is a front elevational view of a link for connecting parts of the lifting heddle in accordance with another embodiment.

FIG. 3*a* shows the lifting heddle in accordance with another embodiment of the present invention. Here a middle part 3 of the link 4*a* is as wide as the upper section 2 of the body of the lifting heddle. This facilitates the removal of dust, especially the dust forced out of the positioning slot 8, since the end 13 of the positioning slot 8 is exposed due to the design of the link.

Figure 4:
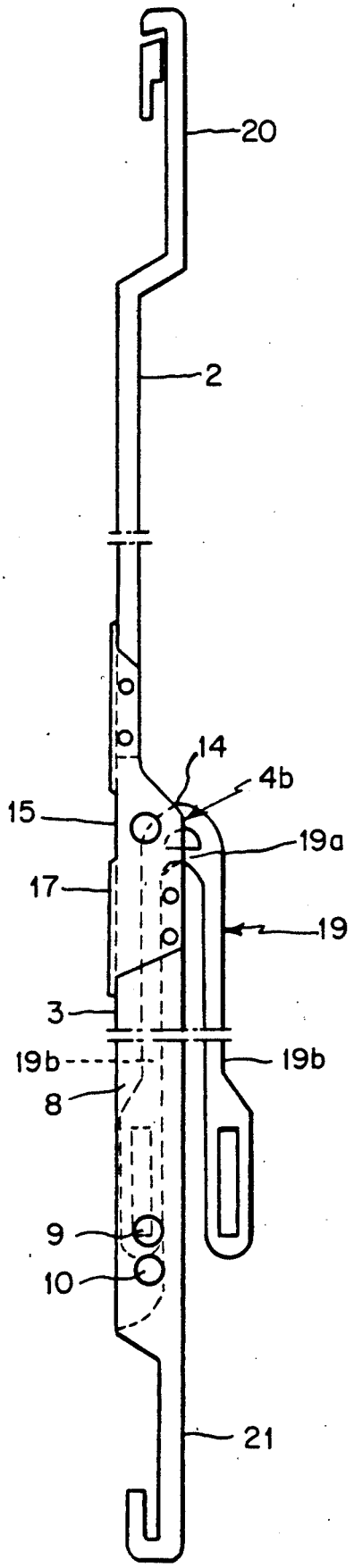
FIG. 4 is a front elevational view showing the link of the inventive heddle, provided with openings.
Figure 5:
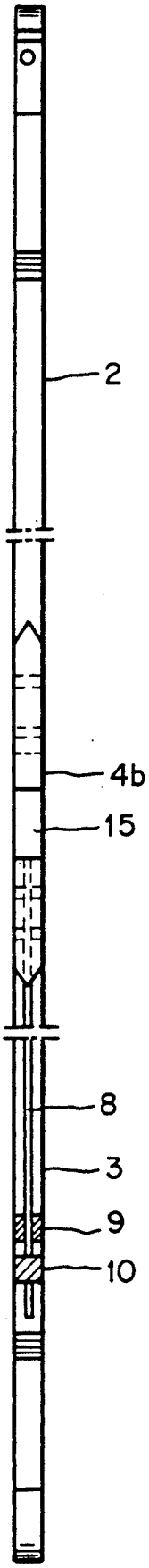
FIG. 5 is a side elevational view of the lifting heddle shown in FIG. 4.

In the embodiment shown in FIGS. 4 and 5 the link 4*b*has an opening 14 in the sidewall 16 and another opening 15 in the wall 17 of the U-shaped rail. Thus, the removal of dust is ensured in this embodiment as well.

Figure 6:
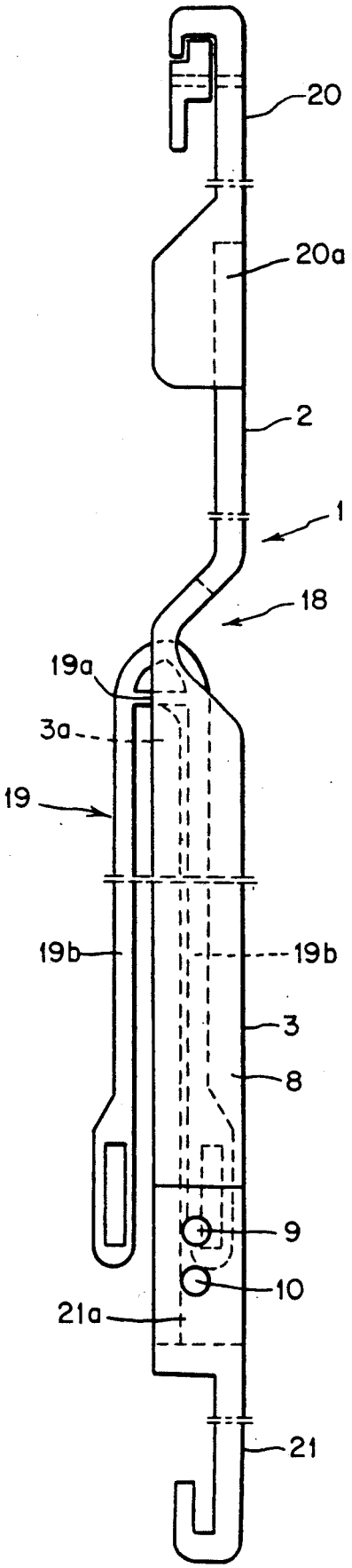
FIG. 6 is a front elevational view of another embodiment of a lifting heddle according to the present invention.
Figure 7:
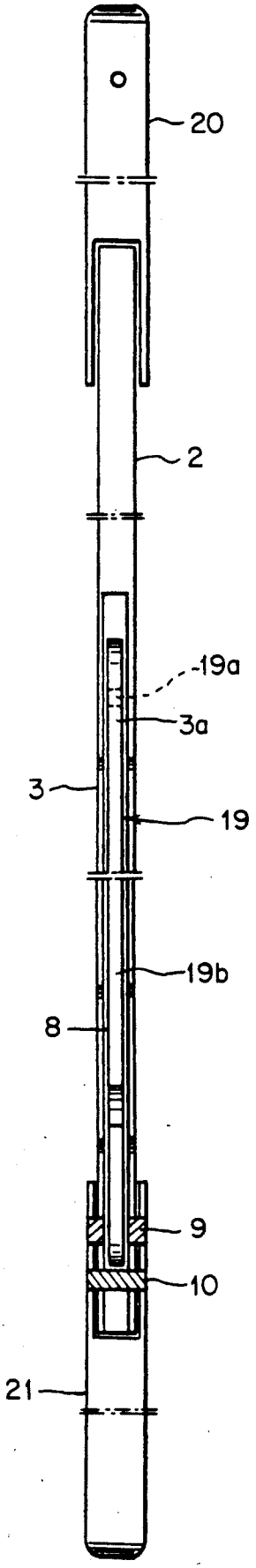
FIG. 7 is a side elevational view of the lifting heddle shown in FIG. 6.

FIGS. 6 and 7 show a lifting heddle with a fastener 20 and 21 at each end, to accommodate the heddle frames. The fasteners are provided with slots 20*a* and 21*a*, respectively. The sections 2 and 3 of the body of the lifting heddle extend into the slots 20*a* and 21*a*. The fasteners 20 and 21 are composed of a plastic material and secured to the respective sections 2 and 3 by cementing or welding, for example, ultrasonic welding.

The lower section 3 of the body of the lifting heddle in the vicinity of the end of the positioning slot 8 is as wide as the upper section 2, exposing the end 18 of the slot.

Thus, while only several embodiments of the present invention have been shown and described, it is obvious that many changes and modifications may be made thereunto without departing from the spirit and scope of the invention.

What is claimed is:

1. A lifting heddle including a half heddle positioned thereon, comprising:

a body having at least two separate sections; and means for adjustably coupling said two sections together so that the lifting heddle can be shortened or lengthened.

2. The lifting heddle as defined in claim 1, wherein said body has a middle, said body being separated in said middle so as to form said two separate sections.

3. The lifting heddle as defined in claim 1, wherein said means for adjustably coupling said sections with one another includes a link.

4. The lifting heddle as defined in claim 3, wherein said link is formed as a U-shaped rail.

5. The lifting heddle as defined in claim 3, wherein said means for adjustably coupling includes means for fixing said sections to said link.

6. The lifting heddle as defined in claim 3, wherein said link is provided with openings.

7. The lifting heddle as defined in claim 3, wherein said sections include a wider section provided with a positioning slot and a narrower section, said link in the vicinity of an end of said slot being as wide as said narrower section so as to expose said end of said slot.

8. The lifting heddle as defined in claim 3, wherein said sections of said body are composed of a plastic material while said link is composed of metal.

9. The lifting heddle as defined in claim 5, wherein said fixing means include rivet means.

10. The lifting heddle as defined in claim 4, wherein said U-shaped rail has a base wall and two sidewalls, one of said base wall and said sidewalls being provided with openings.

11. The lifting heddle as defined in claim 1, wherein one of said sections of said body is wider than the other of said sections.

12. The lifting heddle as defined in claim 1, wherein said body has two ends, and further comprising two fasteners each provided on a respective one of said ends for accommodating heddle frames.

13. The lifting heddle as defined in claim 12, wherein said fasteners have slots that receive said sections of said body respectively.

14. The lifting heddle as defined in claim 12, wherein said fasteners are composed of a plastic material.

15. The lifting heddle as defined in claim 12, wherein said sections include a wider section and a narrower section, and further comprising said half heddle positioned on said wider section and means for magnetically controlling said half heddle mounted on said wider section, said wider section being provided with a stop for said half heddle.

16. The lifting heddle as defined in claim 15, wherein said wider section has a slot for positioning said-half heddle, said stop being located in said slot.

17. The lifting heddle as defined in claim 16, wherein said half heddle has a leg of a predetermined length and said positioning slot has an upper end, said stop being spaced from said upper end of said positioning slot by a distance which is substantially equal to the length of said leg of said half heddle.

18. The lifting heddle as defined in claim 16, wherein said sections include an upper section and a lower section, said lower section in the vicinity of an end of said positioning slot having a width which corresponds to the width of said lower section so as to expose said end of said slot.

19. The lifting heddle as defined in claim 13, further comprising means for securing said sections in said slots of said fasteners.

20. The lifting heddle as defined in claim 1, wherein said sections include a wider section and a narrower section;

said wider section adapted to have said half heddle positioned on said wider section; and said wider section being provided with a stop for said half heddle.

21. The lifting heddle as defined in claim 20, wherein said wider section has a slot for positioning said half heddle, said stop being located in said slot.

22. The lifting heddle as defined in claim 20, further comprising means for magnetically controlling said half heddle.

23. A lifting heddle, comprising:

a body having at least two separate sections;

means for adjustably coupling said two sections together so that the lifting heddle can be shortened or lengthened;

wherein said means for adjustably coupling said sections with one another includes a link, with said link being formed as a U-shaped rail; and wherein said U-shaped rail has a base wall and two sidewalls, at least one of said base wall and said sidewalls having a tapered end.

24. The lifting heddle as defined in claim 23, wherein said base wall and said sidewalls have ends which are tapered.

* * * * *